United States Patent [19]

Baron

[11] 4,150,812

[45] Apr. 24, 1979

[54] LOAD EQUALIZING BAIL ASSEMBLY

[75] Inventor: George B. Baron, Marion, Ohio

[73] Assignee: Dresser Industries, Inc., Dallas, Tex.

[21] Appl. No.: 844,494

[22] Filed: Oct. 21, 1977

[51] Int. Cl.[2] ..... B66D 1/36

[52] U.S. Cl. ..... 254/190 R; 414/690

[58] Field of Search ..... 254/135 CE, 190 R, 192, 254/197, 139, 172, 173 R, 174, 175, 175.5, 188; 214/135 R, 138 R, 136; 212/8 R, 17, 61, 35 HC; 187/1 A, 34; 188/65.1, 64, 65.3, 188; 403/165; 37/115, 135

[56] References Cited

U.S. PATENT DOCUMENTS

| | | | |
|---|---|---|---|
| 1,507,712 | 9/1924 | Proudfoot | 254/135 CE |
| 2,372,232 | 3/1945 | Thornburg | 254/190 R |
| 3,117,686 | 1/1964 | Brown | 214/138 R |
| 3,472,343 | 10/1969 | Williams et al. | 254/175 |
| 3,843,095 | 10/1974 | Rupert | 254/174 |
| 3,933,260 | 1/1976 | Knoniokken et al. | 214/135 R |

*Primary Examiner*—Trygve M. Blix
*Assistant Examiner*—Kenneth W. Noland
*Attorney, Agent, or Firm*—Mason, Fenwick & Lawrence

[57] ABSTRACT

A bail assembly for a rope drive mechanism is described which operates to equalize the loads on the ropes extending through it and minimize bending of those ropes. Two ropes are looped through the bail around small sheaves which are rotatably mounted on a double eccentric shaft. The ropes are guided to and from the sheaves in the same plane. The bail assembly is mounted to align itself with the plane of the ropes, and it is balanced so that its weight will not bend the ropes under slack conditions. Provisions are made for the bail assembly to operate to remove slack in the ropes by exerting its weight on the ropes.

11 Claims, 9 Drawing Figures

30
66
40
78
90
80
76
80
83a
82a
83a
82a
72
39

40
66
67
67
66
71
68
70
78
80
82b
68
70
83a
76a
74
84
82a
72

30
8
30
7
66
66
67
67
69
71
64
6
85
6
92b
83a
83b
80
92b
76b
76a
62
60
64
7
8
74
72
38
22
22
39

LOAD EQUALIZING BAIL ASSEMBLY

BACKGROUND OF THE INVENTION

This invention relates to wire rope drive mechanisms and more particularly, the invention is related to a bail assembly used as a rope anchor in such mechanisms.

The invention finds particular application in devices such as revolvable power shovels and the like which are particularly adapted to digging horizontally. In shovels of this type the power for both digging and lifting comes principally from the hoist mechanism which continues to take up rope more or less constantly from the starting to the dumping position. A machine of this type is illustrated in detail in U.S. Pat. No. 3,501,034 issued Mar. 17, 1970 to George B. Baron and assigned to the Marion Power Shovel Company, Marion, Ohio.

In connection with power shovels of this general type two hoist ropes can be used, and it is known to use a bail mechanism as an anchor for those ropes forming four rope lines extending to and from the bail. However, the bail mechanisms now in use are presently of a construction which weighs far too much and is far too bulky. Furthermore, in such prior art bail configurations the ropes generally do not leave the bail in a single plane. This means that, as the distance between the bail and the boom point sheaves varies during operation, the ropes must bend and unbend slightly at the point where they leave the bail. Remembering that wire rope is used, it can be seen that such bending will be abusive because it takes place over a grooved radius whch is much smaller than that of the sheave grooves recommended for the particular size wire rope which must be used as hoist rope. Such continuous bending and unbending causes fatigue and eventual deterioration of the rope.

It is, therefore, an object of this invention to provide a bail assembly for wire rope drives wherein four rope lines in relatively close proximity are used and which produces a substantially equal pulling force on each of the rope lines.

It is another object of the invention to provide a bail assembly for a four-rope line, wire rope drive, which permits rope drive operation to take place with minimal bending of the wire rope being caused by the bail assembly.

A further object of this invention is to provide a bail assembly for a four-line wire rope which minimizes the occurrence of slack in the rope and thereby minimizes the occurrence of fouling elsewhere in the rope drive system.

Still another object of the invention is to provide a bail assembly for a wire rope drive utilizing four-rope lines which is capable of properly functioning during highly dynamic operating conditions to maintain its normal moving pattern thereby not becoming cocked and jammed.

It is another object of the invention to provide a bail assembly for a wire rope drive wherein, if necessary, where there is insufficient room for the bail between upper and lower sheaves when the rope drive system approaches its limit the bail assembly contacts those portions of the sheaves which are less easily damaged and in effect allows the bail assembly to operate as part of one of the sheaves.

Still another object of the invention is to provide a bail assembly for a wire rope drive where means are provided for maintaining the ropes in firm contact with the sheaves of the bail assembly as they go through it while allowing the rope freedom of movement without excessive rubbing.

SUMMARY OF THE INVENTION

The aforementioned and other objects are achieved in accordance with the principles of this invention by providing a bail assembly for a four-rope line, wire rope drive wherein two wire ropes pass around freely turning small sheaves or thimbles so that the pulling forces on the two portions of each rope are equalized. A thimble for each rope is rotatably mounted on each eccentric portion of a double eccentric member, also freely turning, thereby equalizing the pulling forces between the two ropes.

The ropes are gently forced into the same plane in going to and from the thimbles in such a way as not to be pinched and in such a way as to insure that the ropes are not forced to bend in an arc which would have the effect of deteriorating the rope.

A link mounting arrangement is provided for the bail assembly so that if the rope pull becomes light, the entire assembly can in effect lean forward or backward as necessary, and the weight of the bail assembly can maintain some minimum pull on the ropes. The links are are so constructed that the minimum rope pull will always be at least equal to the bail weight. In the circumstance, where the ropes are substantially vertical in the slack condition, the bail assembly will slide downward in the links so that the ropes at least experience the pulling force of the bail assembly. This avoids the problem that if the ropes are nearly vertical, the bail mechanism would remain balanced in an upright position and would not take up any slack. In order to warn the operator that a slack condition is impending a limit switch is mounted on the links to respond to such a condition with link operation.

The bail assembly is equipped with stop blocks which are so located and shaped that they make contact with, for example, the upper sheaves in a hoist rope assembly in the bottom of the sheave grooves which are normally not easily damaged. At this point, further hoist motion causes the bail to act like part of the sheaves and it begins to wrap over them.

Rope clamps are provided to keep the wire ropes in firm contact with the small sheaves about which they extend in the bail assembly. The clamps are so constructed and arranged as to "float" in the bail structure and not to touch anything except the ropes themselves.

Therefore a bail assembly is provided which effects load equalization in a relatively compact and light assembly in such a way as to maintain the ropes in substantially the same plane as they enter and leave the bail mechanism and with minimal bending.

BRIEF DESCRIPTION OF THE DRAWINGS

The principles of the invention will be more readily understood by reference to the description of a preferred embodiment given herein below in conjunction with the drawings which are briefly described as follows.

DETAILED DESCRIPTION OF THE PREFERRED EMBODIMENT

Figure 1:
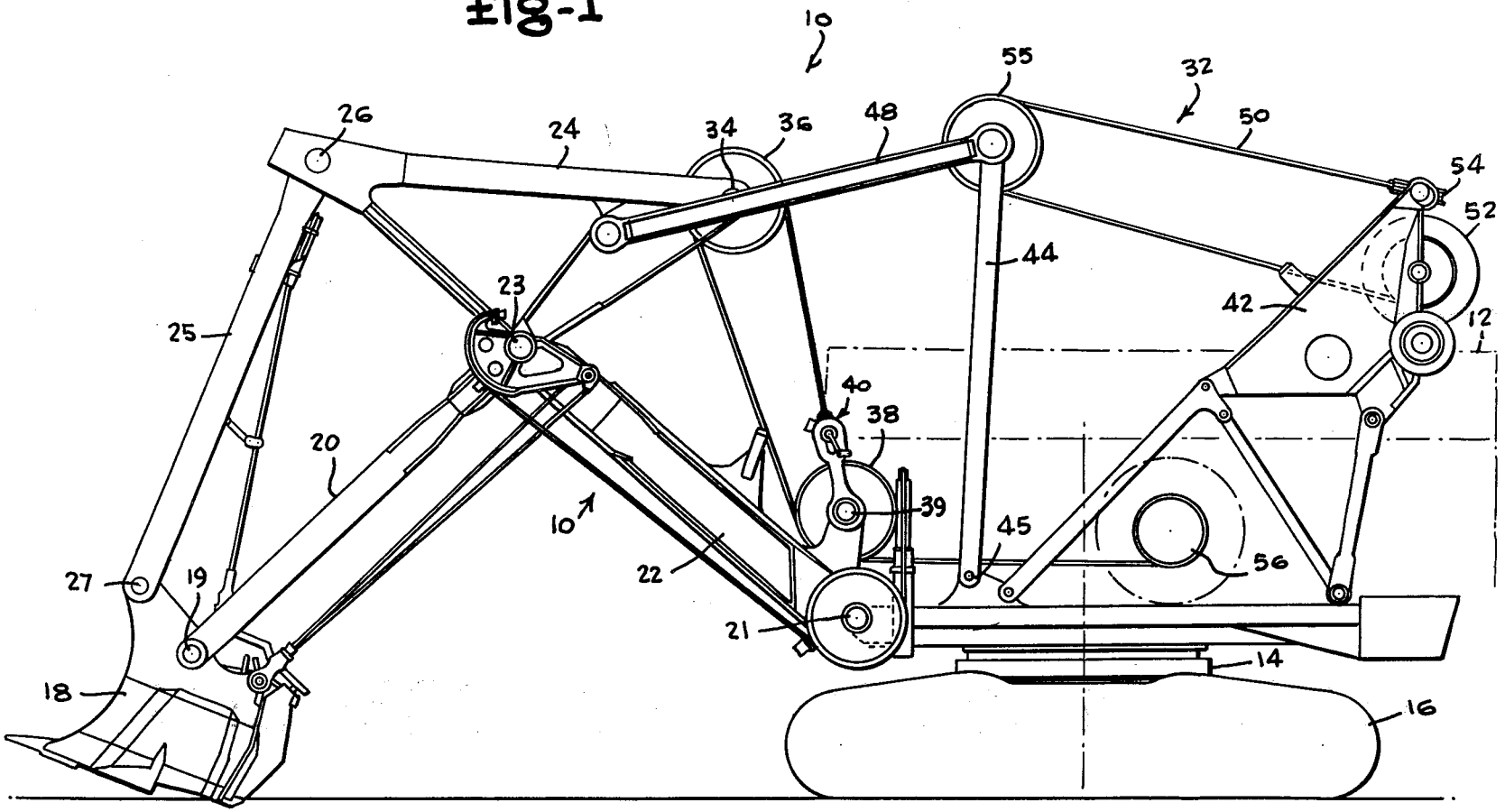
FIG. 1 is a side elevation of a power shovel, partially cut away, illustarting the environment in which the bail assembly of this invention operates.
Figure 3:
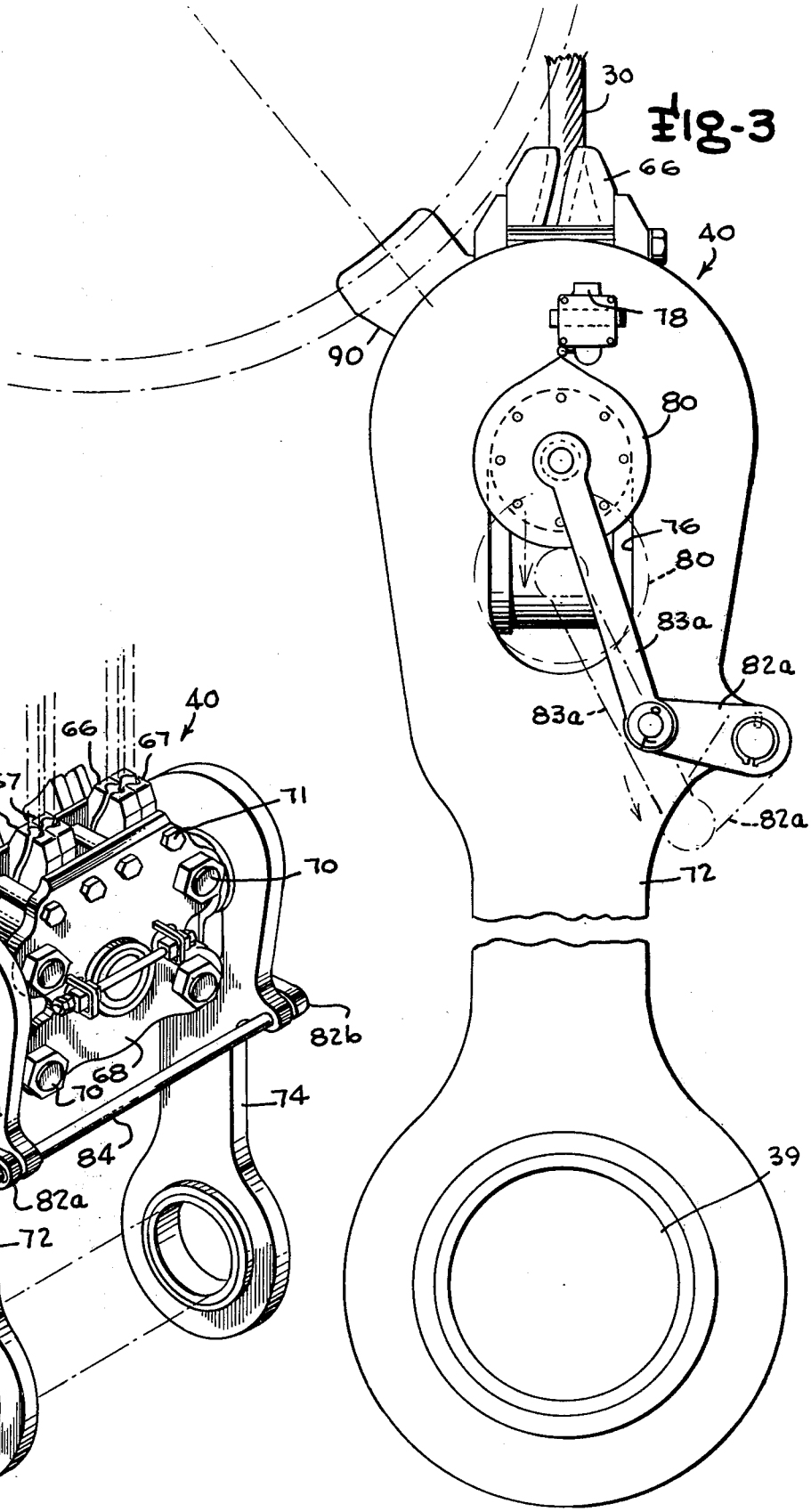
FIG. 3 is a side elevation of the FIG. 2 embodiment.
Figure 2:
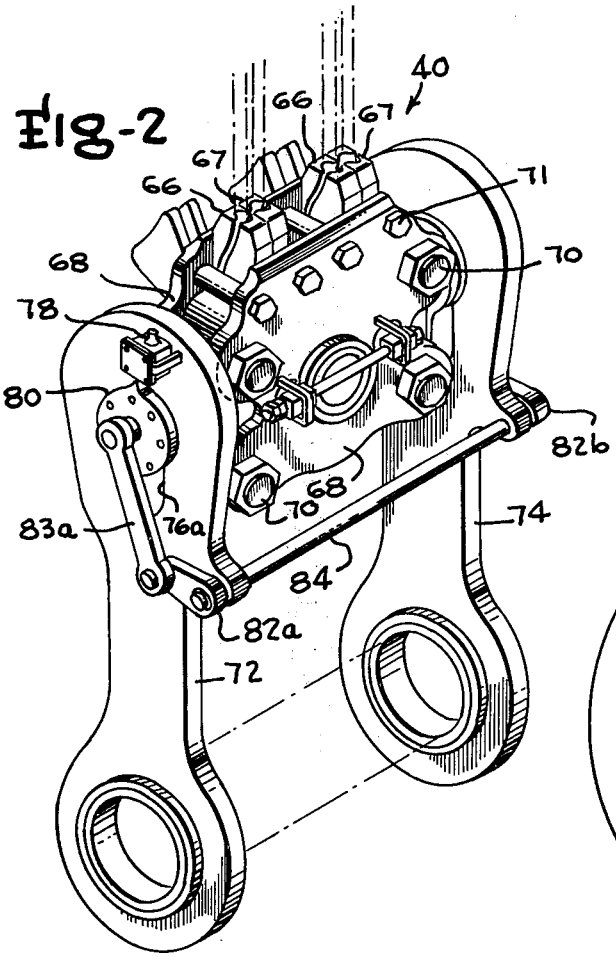
FIG. 2 is a perspective view of the preferred embodiment of the bail assembly of this invention.
Figure 4:
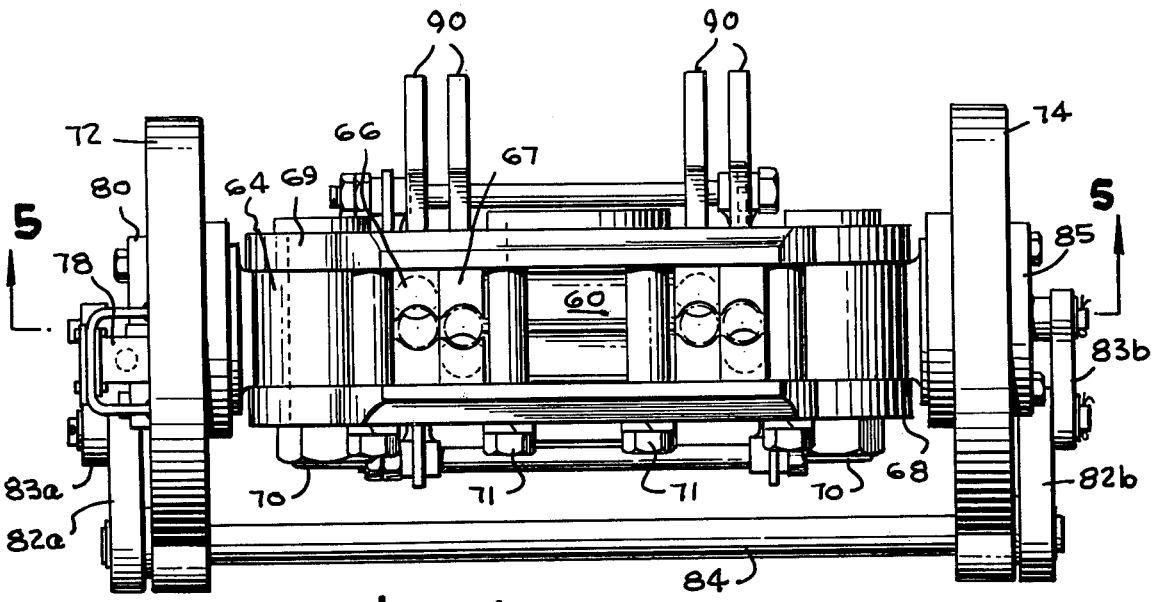
FIG. 4 is a top plan view of the FIG. 2 embodiment.

In FIG. 1 there is illustrated a power shovel similar to that described in detail in the aforementioned U.S. Pat. No. 3,501,034 illustrating the environment wherein a preferred embodiment of the bail assembly according to the invention can be used.

Power shovel 10 has a body 12 supported for rotation on a base 14 which is in turn mounted upon crawlers 16. The shovel in the usual manner can be moved from place to place by operation of the crawlers, and the body can be rotatably moved to swing from side to side by suitable power means mounted within the housing of body 12. The body, base and crawlers, as stated, are of conventional construction and can be constructed according to the aforementioned U.S. patent.

A bucket, or dipper, 18 is pivotally connected at 19 to a handle 20 which is in turn pivotally connected to a stiff leg 22 by a head shaft 23. A stiff leg is pivotally connected to the machine body at 21. A hoist frame 24 is also connected to head shaft 23, and a hoist link 25 ties the hoist frame to dipper 18 by means of pivots 26 and 27. The hoist frame, hoist link, handle and dipper move as a unit about the head shaft, and there is no relative movement among these parts except when the dipper moves about its pivotal connection with the handle in changing pitch. A hoist line 30 controls movement of the hoist frame about the head shaft, and a crowd mechanism 32 controls movement of the hoist frame and stiff leg about pivot mechanism 21.

Hoist frame 24 includes laterally spaced hoist frame members 32 extending generally in the direction of handle 25 but oppositely from head shaft 23. The hoist frame members are journaled to the head shaft 23 at one end thereof, and at the other end they carry a shaft 34 for mounting hoist sheaves 36.

The hoist frame, handle and dipper are moved about the head shaft by means of hoist line 30. This hoist line extends from bail mechanism 40, is reeved about the sheaves 36 at the top of the hoist frame and about sheaves 38 at the lower end of the stiff leg and is then wound about a hoist drum 52.

In order to accomplish movement of stiff leg 22 about pivot 21 a crowd mechanism 32 is provided. The crowd mechanism includes a gantry 42 at the rear of the body and a movable mast 44 pivotally connected to the body at 45. Mast 44 is connected to shaft 46 by means of crowd shaft 48 and to the gantry by means of crowd ropes 50. The crowd rope 50 is anchored to the gantry at bail 54, passes around sheaves 55 and is wound around a crowd drum 52.

FIGS. 2 through 9 illustrate in greater detail the construction and operation of a preferred embodiment of the bail mechanism according to the invention, and in these figures like reference numerals refer to like elements. The following discussion will refer to FIGS. 2 through 9 concurrently.

Figure 6:
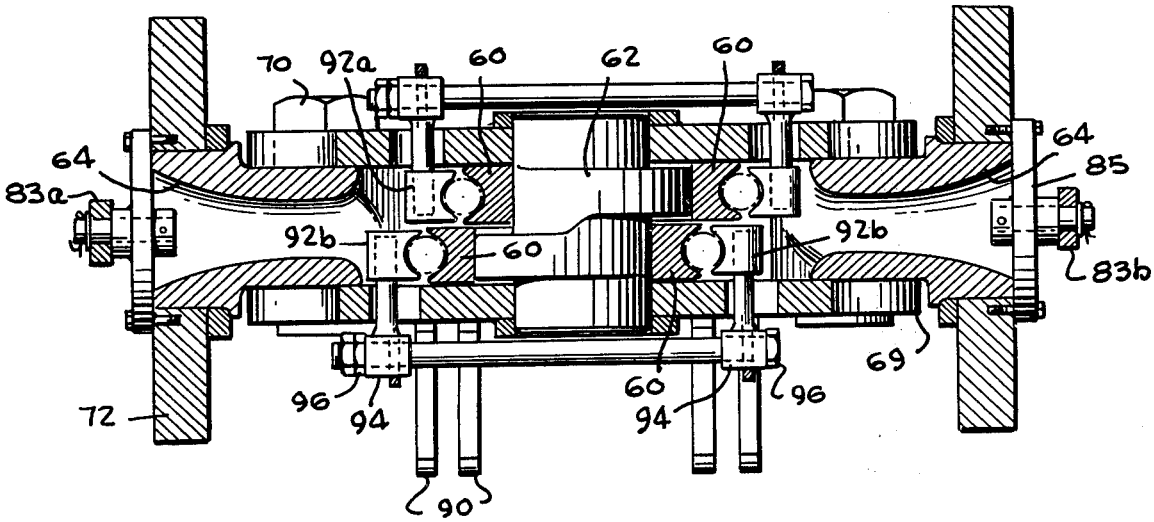
FIG. 6 is a horizontal section through the FIG. 2 embodiment as taken at the line 6—6 in FIG. 5.
Figure 5:
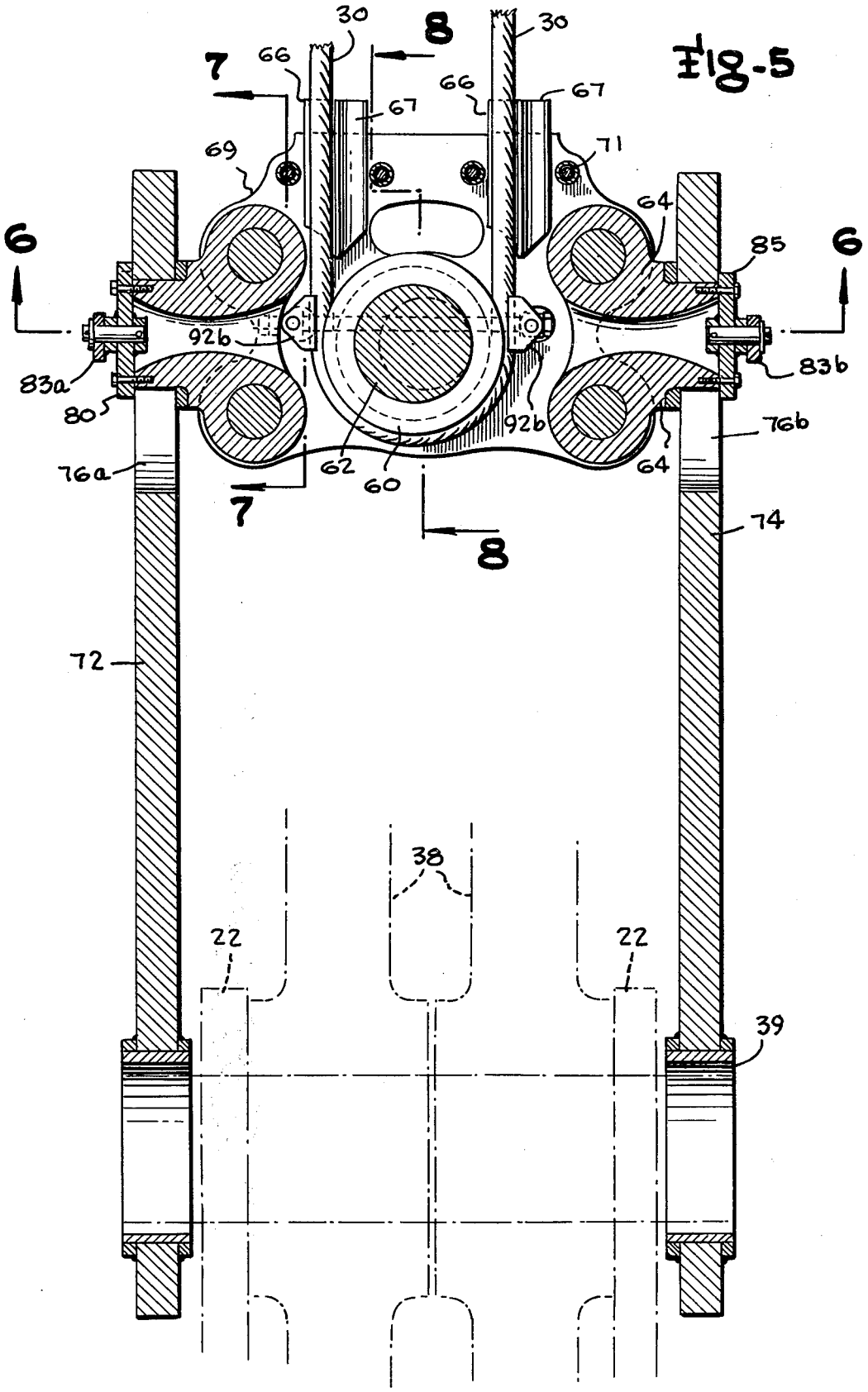
FIG. 5 is a vertical section through the FIG. 2 embodiment as taken through the line 5—5 in FIG. 4.
Figure 7:
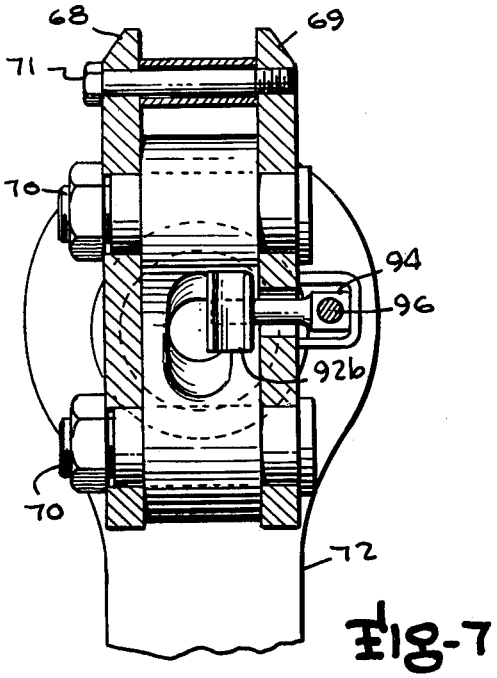
FIG. 7 is a vertical section through the FIG. 2 embodiment as taken at the line 7—7 in FIG. 5.
Figure 8:
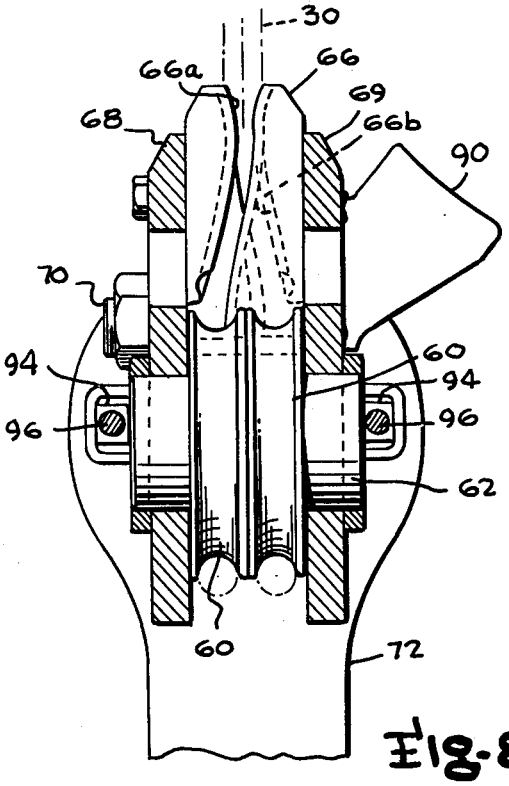
FIG. 8 is a further vertical section through the FIG. 2 embodiment as taken at the line 8—8 in FIG. 5

In bail assembly 40 which is constructed according to the principles of the invention as best shown in FIG. 5, two ropes 30, preferably, wire ropes are looped through bail assembly 40 so as to make four rope lines sharing the load. In the example shown in FIG. 1, these four rope lines extend around upper hoist sheave 36 of power shovel 10 and thereby cause hoist frame 24 to move about head shaft 23. Within the bail assembly, hoist ropes 30 extend around, respectively, a pair of freely rotating thimbles or small sheaves 60. Thus, the pulling force on each of the two parts of a given rope is equalized. The thimbles 60 are mounted for rotation on a double eccentric shaft 62 with a thimble being mounted on each eccentric portion as best shown in FIG. 6. The eccentric rotation of thimbles 60 as brought about by eccentric shaft 62 insures that the total pulling force on one rope will be equal to the total pulling force on the other.

The bail assembly is pivotally mounted by means of trunnions 64 and cam 80 and retaining plate 85 on links 72 and 74 so that the assembly is free to effectively align itself with the plane of the ropes 30. It is preferable that the bail assembly be so constructed as to be weight-balanced about the axis of trunnions 64 so that the weight of the assembly will not bend the ropes when a slack condition occurs. As previously mentioned, it is an object of this invention to provide a bail assembly which will allow the four rope lines to operate in the same plane. Obviously, the thimbles 60 are not in the same plane but in parallel planes. In order to allow the rope lines 30 to extend in the same plane from thimbles 60, rope guides, or ramps, 66 and 67 are provided. These ramps 66 and 67 are of identical construction, each have descending grooves *66a, 67a* providing entrances and ascending grooves *66b, 67b* providing exits for the rope line. Each ramp 66 and 67 then guides the rope it receives into a respective one of the thimbles 60 arranged to receive that rope and guides that rope from that thimble 60 into the plane of operation.

The entire bail assembly as discussed to this point is mounted within parallel bail frame members 68 and 69 which are assembled together with bolts 70 and 71. When the bail frame members 68 and 69 are drawn together by tightening the bolts 70 and 71, the ropes 30 are gently forced into a common plane as determined by the entrances and exits from ramps 66 and 67. Preferably, at no point is the rope forced to bend in an arc which is less than 9.5 times the rope diameter. Thus, the diameter of the thimbles 60 and the arrangement of grooves *66a, 67a* and *66b, 67b* are selected to bring about this result. This produces a pressure on the ropes 30 in ramp grooves *66a, 67a* and *66b, 67b* which is moderate even under a full working load. Under full working loads there are forces which tend to in effect split the bail assembly, but these are easily resisted by bolts 71.

At this point, it should be noted that the reeving of the ropes 30 is such that the inside rope on one side of the bail assembly becomes the outside rope on the other side. By having this alternating arrangement, instead of an inside rope and an outside rope, the advantage is achieved that each of the ropes 30 can be of the same length. This is accomplished by grooving hoist drum 56 with two double pitched helices arranged symmetrically about the center line of machine 10. The ropes can be anchored onto the drum symmetrically on each end flange 180° apart and in the same radial plane. By making the drum in this fashion and using the bail assembly as described herein, the hoist ropes can be of exactly the same length.

The bail assembly as described hereinabove is mounted, for example, on power shovel 10 by means of links 72 and 74 which at their lower ends are pivotally mounted about lower hoist sheave shaft 39. This pivot mounting arrangement permits the entire assembly to lean forward or backward responsive to changes in the values of the pulling forces on the ropes 30. Thus, the weight of bail assembly 40 can be used to maintain some minimum pull on the ropes. There are, however, those situations when ropes 30 will be extending from bail assembly 40 at substantially the vertical, and in this case the bail assembly would remain balanced in an upright position and not be able to lean as discussed above to take up any slack. To forestall such a possibility the portion of the bail assembly mounted within frame members 68 and 69 is slidably mounted by trunnions 64 and cam 80 and retaining plate 85 in elongated slots **76*a* and 76*b* in, respectively, links 72 and 74. Thus, should the ropes 30 assume a substantially vertical position the bail assembly will tend to slide downwardly in the elongated slots 76*a* and 76*b*, and in this position the ropes will experience at least the minimum pulling force of the weight of the bail assembly. Two modes of slack takeup have, then, been provided by, respectively, the pivotal motion of the links 72 and 74 on lower hoist sheave shaft 39 and by the presence of elongated slots 76*a* and 76*b*** in the links.

In any type of machine on which a bail assembly according to the invention might be mounted, it is necessary that the operator be warned that the occurrence of a slack condition is impending. To this end limit switch 78 is mounted on link 72 in the position shown to respond to the motion of the link or the bail assembly as they travel toward the position to be assumed upon the appearance of the slack condition. A cam 80 is provided and is attached to the outer end of one of the trunnions 64 so that this cam will follow any pivoting motion of the bail assembly. Cam 80 in this embodiment holds limit switch 78 is a normally actuated condition, and if links 72 and 74 tend to fall foward or backward due to a slack condition, the bail will tend to remain aligned with the ropes 30. This will result in a turning motion of cam 80 deactuating the limit switch. In the situation where the ropes have assumed a nearly vertical position and a slack condition occurs, the bail assembly will simply drop straight down in slots **76*a* and 76*b*** so that the cam will move away from and deactuate the limit switch.

It is to be expected that the bail assembly will be required to operate under highly dynamic conditions. Under such conditions it is possible for one end of the bail assembly to drop down in one of the the slots **76*a* or 76*b* before the other and this will result in the bail assembly being jammed in a cocked position. To prevent this a stabilizing linkage structure has been added. This stabilizing linkage includes a shaft 84 which is pivotally keyed at either end into levers 82*a* and 82*b* which are in turn pivotally keyed into levers 83*a* and 83*b*. The latter levers are, respectively, pivotally connected to cam 80 and retaining plate 85** on opposite ends of the bail assembly. This arrangement assures that the motion of an end of the bail assembly within the links will be transmitted to the other end of the bail assembly so that the entire assembly will move straight up and down and not assume a cocked position.

When a hoist arrangement in which the bail assembly of this invention might be used approaches its limit, i.e., the hoist drum is full, the hoist geometry will usually be such that there will be insufficient room for the bail assembly between the upper and lower hoist sheaves. In order to prevent damage to the hoist sheaves or to the bail and to prevent excessive local bending of the ropes stop blocks 90 have been provided and mounted in the positions most clearly shown in FIGS. 2 and 3. These stop blocks are so located and shaped that when the limit condition is approached they make contact with the upper sheaves in the bottom of the sheave grooves. Normally the sheave grooves are flame hardened and therefore will not be easily damaged. Should further hoist motion occur the bail assembly will in effect act like it is a part of the sheaves and it will begin to wrap up over them. Engagement of the stop blocks 90 with the upper hoist sheaf is diagrammatically illustrated in FIG. 3.

Figure 9:
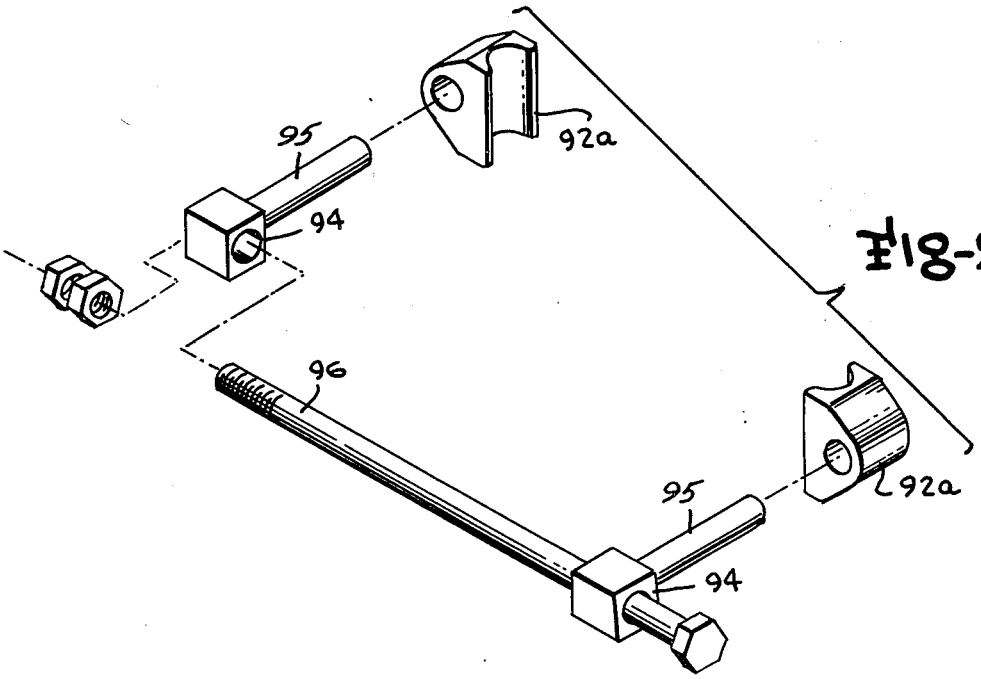
FIG. 9 is an exploded perspective view of the parts constituting the bail assembly rope clamp.

A principal problem in bail mechanisms of the type here in question is that the wire ropes used must be bent around small diameter sheaves which, while of sufficient diameter for a stationary bend of the rope are generally of much smaller size than recommended for preventing fatigue failures of the rope. The fatigue failures in question generally occur in the wires near the tangent points because under dynamic conditions the rope tends to spring away from the thimble when the load is released and then engage it again when the load is applied. Repeated occurrences of this nature cause repeated radical changes in the bend radius of the ropes, as well as mechanical wear on the wires which are in contact with the thimble. In order to prevent this condition pairs of rope clamps **92*a* and 92*b* are provided and positioned as shown in FIGS. 5 and 6 to be carried in openings in frame members 68 and 69 as shown in those Figures. The clamps are so shaped and arranged as to keep the ropes 30 in firm contact with the thimbles under all conditions to thereby avoid the wear and fatigue discussed above. In so doing, however, it is important that the respective pairs of rope clamps 92 be permitted to "float" laterally so that the small movements of the rope necessary to keep rope pulls equalized will not cause the rope to rub excessively against the clamps 92. As indicated in the drawings each thimble is provided with a pair of rope clamps 92*a* or 92*b*, and the clamps in each pair are placed substantially 180 degrees apart, and the clamps forming a pair are tightened against each other by means of a long bolt 96 and trunnions 94 which receive the bolt and are connected to the rope clamps. Pins 95 extend through the openings in the case member 68 and 69 and connect the respective clamps 92 to the associated trunions 94. The latter arrangement for one pair of clamps, i.e., the clamps for one sheave is shown in FIG. 9. In order to insure that this floating motion will always occur the holes through frame members 68 and 69** are sufficiently large that there is always clearance in all directions.

The preferred embodiment of the invention described hereinabove is to be considered only as being exemplary of principles of invention. The bail assembly of the invention can be used with a wide variety of rope drive mechanisms. It is contemplated that a number of modifications to or changes in the described embodiment can be made, such as changes in pivoting arrangements while remaining within the scope of the invention as defined in the appended claims.

What is claimed is:

1. In a rope drive a bail assembly for anchoring two ropes and forming four rope lines extending to and from the bail assembly comprising:

a frame structure, a pair of sheaves rotatably mounted in said frame structure for anchoring and changing the direction of motion of said ropes, a double eccentric shaft journaled into said frame, each of said sheaves being mounted for rotation on one of the throws of said eccentric for equalizing the total pulling force between said two ropes and rope guide means having a pair of entrances and a pair of exits all of which are in the same plane, which receive said ropes and from which said ropes extend, said rope guide means including descending grooves for guiding each said rope from the plane of said entrances to the respective planes of a said sheaves and ascending grooves for guiding said wire ropes from the planes of each of said sheaves to the plane of said exits.

2. The bail assembly defined in claim 1 wherein said ropes are of the same length and wherein said sheaves and said rope guide means are arranged such that a said rope entering an exterior one of said entrances leaves an interior one of said exits and vice-versa.

3. The bail assembly defined in claim 1 further comprising pivotal mounting means for said bail assembly wherein the pivotal axis of the mounting means extends through a point of the bail assembly about which it is weight-balanced.

4. The bail assembly defined in claim 3 wherein said pivotal mounting means further comprises link means attached to said frame structure for pivotally connecting the bail assembly to the apparatus with which it is used for allowing the bail assembly to move to maintain a minimum pulling force on said ropes.

5. The bail assembly defined in claim 4 wherein said link means includes elongated slots for receiving the ends of said bail assembly and in which the bail assembly is free to move in the vertical plane for permitting the bail assembly to exert a minimum pulling force corresponding to its weight on said ropes when said ropes extend vertically.

6. The bail assembly defined in claim 5 further comprising a stabilizing linkage for transmitting motion of one end of said bail assembly in one of said elongated slots to the other end of said bail assembly in the other of said elongated slots thereby avoiding cocking and jamming of said bail assembly in said elongated slots.

7. The bail assembly defined in claim 1 further comprising rope clamp means for maintaining said ropes in firm contact with said sheaves.

8. The bail assembly defined in claim 7 wherein said rope clamp means includes a pair of clamps for each sheave for holding a said rope against each side of that sheave, each clamp in a said pair of clamps being attached to the other through the bail assembly allowing side-to-side movement of the clamps with lateral movement of the ropes bail assembly.

9. In a bail assembly for anchoring and changing the direction of a rope in a rope drive, the improvement comprising:

a pair of links pivotally connecting, at one end thereof, the bail assembly to the apparatus with which it is used and having elongated slots, at other end thereof, for receiving ends of the bail assembly allowing the bail assembly freedom to move in a vertical plane and thereby permitting the bail assembly to exert a minimum pulling force corresponding to its weight on the rope when the rope extends vertically.

10. The improved bail assembly defined in claim 9 further comprising a stabilizing linkage for transmitting motion of one end of said bail assembly in one of said elongated slots to the other end of said bail assembly in the other of said elongated slots thereby avoiding cocking and jamming of said bail assembly in said elongated slots.

11. In a bail assembly for anchoring and changing the direction of a rope or the like in a hoist arrangement having at least one sheave spaced apart from said bail assembly and receiving the rope, the improvement comprising:

stop blocks mounted on the bail assembly and so located and shaped as to fit within sheave grooves of said sheave and contact the base areas of the grooves when said sheave makes contact with said bail assembly.

* * * * *